United States Patent [19]

Stenberg

[11] Patent Number: 4,659,432

[45] Date of Patent: Apr. 21, 1987

[54] VAT PAPER MACHINE

[75] Inventor: Erik G. Stenberg, Karlstad, Sweden

[73] Assignee: KMW Aktiebolag, Karlstad, Sweden

[21] Appl. No.: 743,437

[22] Filed: Jun. 11, 1985

[30] Foreign Application Priority Data

Jun. 29, 1984 [SE] Sweden ..... 8403472

[51] Int. Cl.[4] ..... D21F 1/00

[52] U.S. Cl. ..... 162/318; 162/319; 162/323; 162/351; 162/354

[58] Field of Search ..... 162/323, 318, 319, 327, 162/354, 357, 320, 321, 314, 140, 110, 351

[56] References Cited

U.S. PATENT DOCUMENTS

| | | | |
|---|---|---|---|
| 905,053 | 11/1908 | Chapman | 162/321 |
| 1,571,715 | 2/1926 | Fearing | 162/110 |
| 1,575,518 | 3/1926 | Allen | 162/110 |
| 1,589,120 | 6/1926 | Crandell | 162/321 |
| 2,005,839 | 6/1935 | Edge | 162/323 |
| 2,665,615 | 1/1954 | Niks | 162/323 |
| 2,723,599 | 11/1955 | Simpson | 162/332 |
| 3,052,296 | 9/1962 | Justus | 162/354 |
| 3,252,854 | 5/1966 | Bowen | 162/327 |
| 3,401,080 | 9/1968 | Keller | 162/321 |
| 4,024,015 | 5/1977 | Kankaanpaa | 162/318 |

FOREIGN PATENT DOCUMENTS

| | | | |
|---|---|---|---|
| 1960884 | 6/1971 | Fed. Rep. of Germany | 162/321 |
| 1303226 | 9/1972 | Fed. Rep. of Germany | 162/318 |
| 2408304 | 9/1975 | Fed. Rep. of Germany . | |
| 4719107 | 9/1972 | Japan | 162/318 |
| 67086 | 11/1943 | Norway . | |
| 0626546 | 7/1949 | United Kingdom | 162/332 |
| 1234123 | 6/1971 | United Kingdom | 162/321 |

*Primary Examiner*—S. Leon Bashore
*Assistant Examiner*—V. Manoharan
*Attorney, Agent, or Firm*—Bell, Seltzer, Park & Gibson

[57] ABSTRACT

A vat paper machine is disclosed, said machine including a cylinder-vat unit having a rotatable cylinder mold, a vat and a headbox for providing a continuous supply of stock to the vat. The vat is arranged upstream of the cylinder mold in such a manner that the wire-covered cylinder mold is brought into contact with stock in the vat to form a first web by draining water from the stock through the wire-covered surface of the mold. An outer wire is also provided which runs in a loop over a breast roll, through the vat along its bottom wall and then over and around a portion of the circumference of the cylinder mold. The portion of the bottom wall of the vat which is located between the breast roll and the cylinder mold includes a platform supporting the outer wire. The platform is provided with slit means that form one or more drainage passages which serve to form a second web on the outer wire. The slit means is arranged at a predetermined distance from a nip located downstream and defined by the outer wire and the cylinder mold so as to avoid detrimental stock flows at the nip which retard formation of the web. The second web is couched with the first web to form a unitary paper web.

11 Claims, 2 Drawing Figures

VAT PAPER MACHINE

FIELD AND BACKGROUND OF THE INVENTION

The present invention relates to a vat paper machine which comprises a cylinder-vat unit having a rotatable cylinder mold, a vat and a headbox connected to the vat for providing a continuous supply of stock to a predetermined level in the vat.

A drum filter of a similar type, in cooperation with an outer dewatering belt, is described in Norwegian Pat. No. 67086. The outer dewatering belt can be said to form a bottom in a vat and is formed of a plurality of strips arranged adjacent each other with slots for dewatering the stock. A first web is thus formed on the drum filter and a second web on the dewatering belt. The webs are then couched together between the dewatering belt and the drum filter to produce a unitary web. A drawback of this design is that irregular flows occur in the stock before the nip where the dewatering belt meets the drum filter since dewatering occurs at the dewatering belt right up to the nip. These flows have an unfavorable influence on the formation of the web in that parts of one or both webs are washed away so that the fiber distribution and grammage of the couched web become uneven. Such a drum filter cannot therefore be used for the production of security paper with true watermarks where considerable demands are placed on the formation and grammage of the web.

German published specification No. 2408304 describes a twin wire former for the production of security paper with watermarks. Stock is injected into the nip between a forming roll and an outer wire. This known apparatus is thus of a completely different type of former than that described herein.

Security paper with so-called true watermarks is generally produced on a cylinder-vat unit in which the wire cloth on the cylinder mold is provided with portions producing a different paper thickness. However, the speed of these formers is limited, as is their ability to produce paper of higher grammage.

SUMMARY OF THE INVENTION

The object of the present invention is to provide a vat paper machine which includes a cylinder-vat unit and an outer wire, which allows paper to be produced at higher speeds and/or paper having a higher grammage than is achievable with conventional vat paper machines, while at the same time achieving the desired formation and desired uniform grammage. Accordingly, the present invention resides in an improved vat machine having a cylinder-vat unit including a rotatable cylinder mold, a vat and a headbox connected to the vat for providing a continuous supply of stock to a predetermined level in the vat. The vat has a bottom wall that is arranged upstream of the cylinder mold in such a manner that a downwardly moving part of the envelope surface of the wire-covered cylinder mold is brought into contact with stock in the vat to form a first web draining water from the stock through said envelope surface, while an outer wire runs in a loop over a breast roll, through the vat along said bottom wall and then over, and around a portion of the circumference of the cylinder mold. The bottom wall of the vat includes a platform positioned between the breast roll and the cylinder mold which supports the outer wire. The platform is provided with slit means which form one or more drainage passages to form a second web on the outer wire by draining water from the stock through at least one of the drainage passages. The drainage passage is parallel to the axis of rotation of the cylinder mold and is arranged at a predetermined distance from a nip located downstream and defined by the outer wire and the cylinder mold. The second web is couched with the first web to form a unitary web which is removed from the cylinder mold. The present invention, therefore, overcomes the shortcomings associated with prior vat paper machines including the elimination of adverse flows at the nip.

According to a preferred embodiment of the invention, the platform is pivotable about a horizontal shaft for moving the end facing away from the breast roll in relation to the axis of rotation of the cylinder mold in order to set the flat upper surface of the platform parallel to and in contact with the outer wire in relation to the diameter of the cylinder mold. In this manner, existing cylinder molds of different diameter and having surface portions producing different watermarks can then be used in one and the same former or cylinder-vat unit.

BRIEF DESCRIPTION OF THE DRAWINGS

The invention will be described further in the detailed description which follows, with reference to the accompanying drawings, in which.

DESCRIPTION OF THE ILLUSTRATED EMBODIMENT

Figure 1:
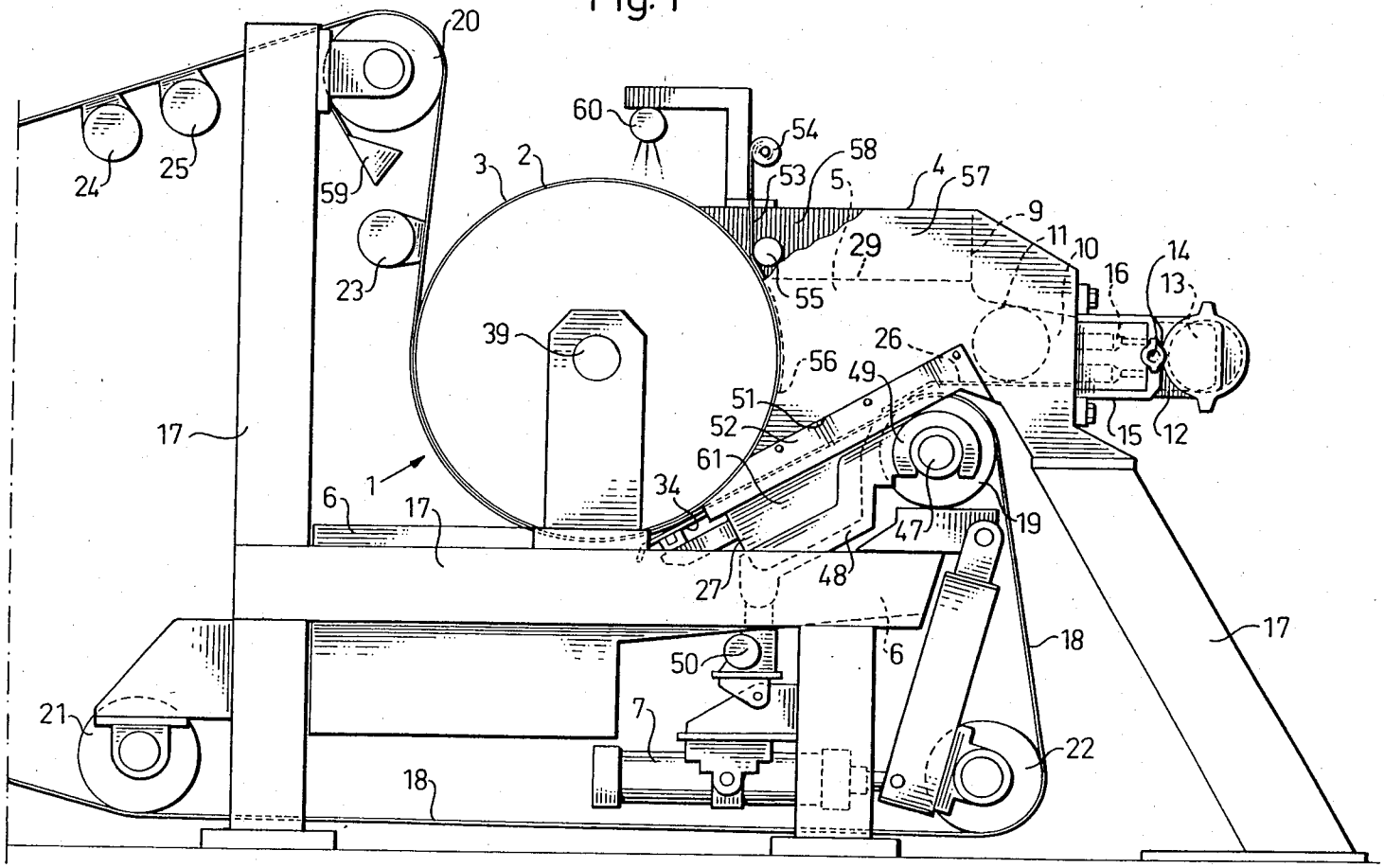
FIG. 1 is a side elevation view with portions broken away of a vat paper machine in accordance with the invention.

With reference to the drawings, which illustrate a preferred embodiment of the invention, FIG. 1 shows the vat section of a vat paper machine including a cylinder-vat unit 1 having a rotatable cylinder mold 2. The cylinder mold consists of a drum open at its opposite ends with one or more endless wire gauzes 3 arranged around it to provide a wire-covered surface. The cylinder-vat unit 1 also includes a vat 4 in which the cylinder mold operates to produce a web by continuous dewatering of the stock 5 contained in the vat 4; the water running into the drum and out through its opposite ends being collected in a container 6 located below the cylinder mold 2. The cylinder mold 2 is kept clean by jets of water from a spray pipe 60.

As is clear from FIG. 1, the vat 4 is located adjacent to the cylinder mold 2 with respect to its vertical central plane and is defined by two side walls 57, 58 spaced from each other, a bottom wall 8 (see FIG. 2) and a back piece 9 with an inlet 10 in which a horizontal perforated roll 11 is preferably arranged to rotate. A headbox 12 is connected to the inlet 10 to supply stock into the vat 4 in such a way that a desired level of stock 5 is maintained in the vat 4.

The headbox 12 preferably has a horizontal, tapering inlet chamber 13 with a stock inlet (not shown) and a secondary outlet 14 arranged at the opposite side of the headbox 12 for excess stock, which is returned to the stock supply. The headbox 12 has a horizontal oblong outlet 15 extending transversely and communicating with the inlet 10 of the vat 4 and includes a stationary hole plate 16 to ensure uniform distribution of the stock along the entire length of the outlet 15.

The above-mentioned members in the form of the cylinder mold 2, vat 4 and headbox 12 are supported by a stand 17 in the vat paper machine.

The vat paper machine also comprises an outer wire 18 arranged to surround a portion of the circumference of the cylinder mold 2, the outer wire 18 being preferably arranged to run in a loop over a plurality of rolls including a breast roll 19, upper and lower guide rolls 20, 21 and a stretch roll 22 which is preferably movable and adjustable by means of a movement transmitting means 7 which may take the form of a hydraulic or pneumatic cylinder for setting the wire tension. Immediately after the cylinder mold 2 a suction box 23 is mounted in contact with the outer wire inside its loop. The suction box is arranged to increase the dry solids content of the web after its transfer from the cylinder mold 2. Two similar suction boxes 24, 25 are mounted after the upper guide roll 20 to remove additional water from the web. The upper guide roll 20 is provided with a doctor blade 59. Similar means may also be mounted in association with other rolls, e.g. at the breast roll 19.

As will be clear from the drawings, the outer wire 18 runs through the vat 4 in contact with the part of the bottom wall 8 which is located between the breast roll 19 and the cylinder mold 2. The bottom wall includes an apron 26 arranged to extend from the outlet 15 of the headbox 12 up to and a sufficient way past the breast roll 19 to form a sealing bridge for the stock flow in connection with the outer wire 18.

The part of the bottom wall 8 of the vat 4 which is located between the breast roll 19 and the cylinder mold 2 consists, according to the present invention, of a supporting platform 27 mounted inside the loop of the outer wire 18 in such a manner that the outer wire 18 will rest on the platform 27 and run along it. As will be clear from FIG. 1, the axis of rotation 47 of the breast roll 19 is preferably located between the horizontal center plane of the cylinder mold 2 and a horizontal lower plane meeting the envelope surface of the cylinder mold 2 at the lowermost point of tangent, and which consequently is parallel to said center plane. The supporting platform 27 of the bottom wall 8 will therefore incline towards the surface of the cylinder mold 2 as is illustrated in the drawings.

The illustrated platform 27 of the bottom wall 8 preferably includes a stand 28 (see FIG. 2) having two parallel side pieces 61, 62 and a front console 30. Between its side pieces 61, 62 the stand 28 supports a flat plate 31, which is deformation resistant and comprises an upper plate member 32 and a lower plate member 33. The plate 31 has a plane, smooth upper surface along which the outer wire 18 slides during its movement in the direction indicated by the arrow. The upper plate member 32 preferably consists of a plastic material, e.g. polyethylene, or is provided with a top layer of such a material, so that the outer wire 18 is subjected to minimum friction. The plate 31 of the platform 27 also includes a sealing lip 34 which is secured to the upper plate member 32 and is located in the plane of the upper surface of the plate 31 to press the outer wire 18 against the wire covered envelope surface of the cylinder mold 2 in such a manner to ensure requisite sealing of the vat 4 while simultaneously maintaining the nip 35 between the outer wire 18 and the cylinder mold 2 with respect to location and geometry. The console 30 of the stand 28 carries a holder 36 having a groove open upwardly in which an external pressure-generating means in the form of a rubber hose 37 or the like may be arranged so as to expand in the direction towards the sealing lip 34. In its disengaged starting position the sealing lip 34 rests freely against the holder 36 for the rubber hose 37. When the rubber hose 37 is expanded, it lifts the sealing lip 34 which then, at a predetermined pressure, causes the outer wire 18 to be pressed against the cylinder mold 2 as described above.

The supporting platform 27 of the bottom wall 8 is equipped with slit means 38 which is arranged to form a second web on the outer wire 18 in a controllable manner. In the embodiment shown the slit means can be completely or partially closed as desired and is arranged in the plate 31, extending parallel to the axis of rotation 39 of the cylinder mold 2 and between the parallel side edges of the outer wire 18. The slit means 38 is located a predetermined distance from the nip 35 where the outer wire 18 comes into contact with the wire-covered surface of the cylinder mold 2, thus forming a section 40 therebetween which is impervious to water. It is important that this section 40 be sufficiently wide, e.g. preferably at least 20 cm based on the normal level in the vat 4, i.e. so that it has sufficient extension in the direction of movement of the outer wire 18 to prevent any unfavorable flows in the stock near the nip 35. Such flows would otherwise destroy the web formed on the cylinder mold 2 and also the web formed on the outer wire 18.

In the embodiment shown the slit means 38 comprises three parallel, elongate, uniform slits 43 distributed evenly along and extending across the plate 31 in such a way that they are parallel to the axis of rotation 39 of the cylinder mold 2. Each slit 43 is transverse with respect to the outer wire and is closeable by means of a closure means in the form of an elongate deformation resistant bar or rod 44 of the same length as the slit 43 which can be inserted into the slit from the side of the platform 27. Each bar 44 is fitted to its associated slit in such a way that it slides easily in the slit and seals the plate 31 of the platform 27 efficiently, the upper surface of the bar 44 being in the plane of the upper surface of the plate 31. In order to withstand the pressure exerted by the stock in the vat 4, each bar 44 may be provided with opposite tongues 45 and each slit 43 with corresponding opposite grooves 46. Each slit 43 forms a drainage passage 41 connecting the vat 4 with the space 42 below the plate 31 via the outer wire 18. According to an alternative embodiment (not shown) the slits differ in width.

In the embodiment shown, the platform 27 of the bottom wall 8 is pivotable about the axis of rotation 47 of the breast roll 19 in that the platform is supported at its side pieces 61, 62 by two support arms 48 having upper bearing means 49 arranged on a shaft including the axis of rotation 47 of the breast roll 19, the support arms 48 being connected at their lower ends to an adjusting means in the form of a screw jack 50 which is mounted on the stand 17. By means of this screw jack 50, the support arms 48, and thus the entire platform 27, can be pivoted about the axis of rotation 47 of the breast roll 19. The invention is thus applicable to cylinder-vat units which have exchangeable cylinder molds 2 having different diameters or which have a cylinder mold 2 the drum of which is sectioned thereby enabling its diameter to be altered to give a larger or smaller envelope surface as desired, and in relation to the dimensions of the cylinder-vat unit 1. By lowering or raising the movable end of the platform 27 which faces away from the breast roll by means of the screw jack 50, the plate 31 can be correspondingly positioned for different diameters of the cylinder mold in supporting cooperation with the outer wire 18 and sealing lip 34 in sealing position against the cylinder mold 2.

The front side wall 57 of the vat 4 may be provided with an opening 51 which can be closed by a cover 52. This opening makes the platform 27 easily accessible so that the bars 44 can be moved freely into and out of their associated slits 43 when desired.

As mentioned above, the water drained off through the cylinder mold 2 and outer wire 18 is collected in the container 6, which also extends below the platform 27 to collect the water passing through the drainage passages 41.

The length of the forming zone of the cylinder mold 2 is usually determined by the level of the stock in the vat 4. As will be clear from FIG. 1, however, the length of the forming zone can be adjusted as desired by means of a water-impervious shielding means in the form of a curtain 53 of suitable material, which is unrolled from a reel 54 and guided towards the cylinder mold 2 by means of a support roll 55. The lower, free edge 56 of the curtain defines the start line of the forming zone, which is thus adjustable.

When one or more bars 44 are removed from the platform 27, this will also produce a forming zone within the area for the draining passage or passages 41 thus exposed, so that said second web will be formed. This second web is then couched with the web formed on the cylinder mold 2 to produce a unitary web leaving the cylinder mold 2. This unitary web has an increased grammage in relation to a web produced only on the cylinder mold under otherwise identical operating conditions. Alternatively, the grammage is retained by increasing the speed of the cylinder mold 2 and outer wire 18.

If desired, a supply of continuous security thread is arranged in known manner in connection to the vat, and fed to the cylinder mold to be embedded in the web being formed.

In order to increase the drainage capacity of a given slit means 38, the platform 27 may be provided with a suitable suction box communicating with the free drainage passage or passages 41 through the plate 31, e.g. by arranging opposite upper and lower side walls and a bottom wall between the two side walls 61 and 62 of the stand 28.

Figure 2:
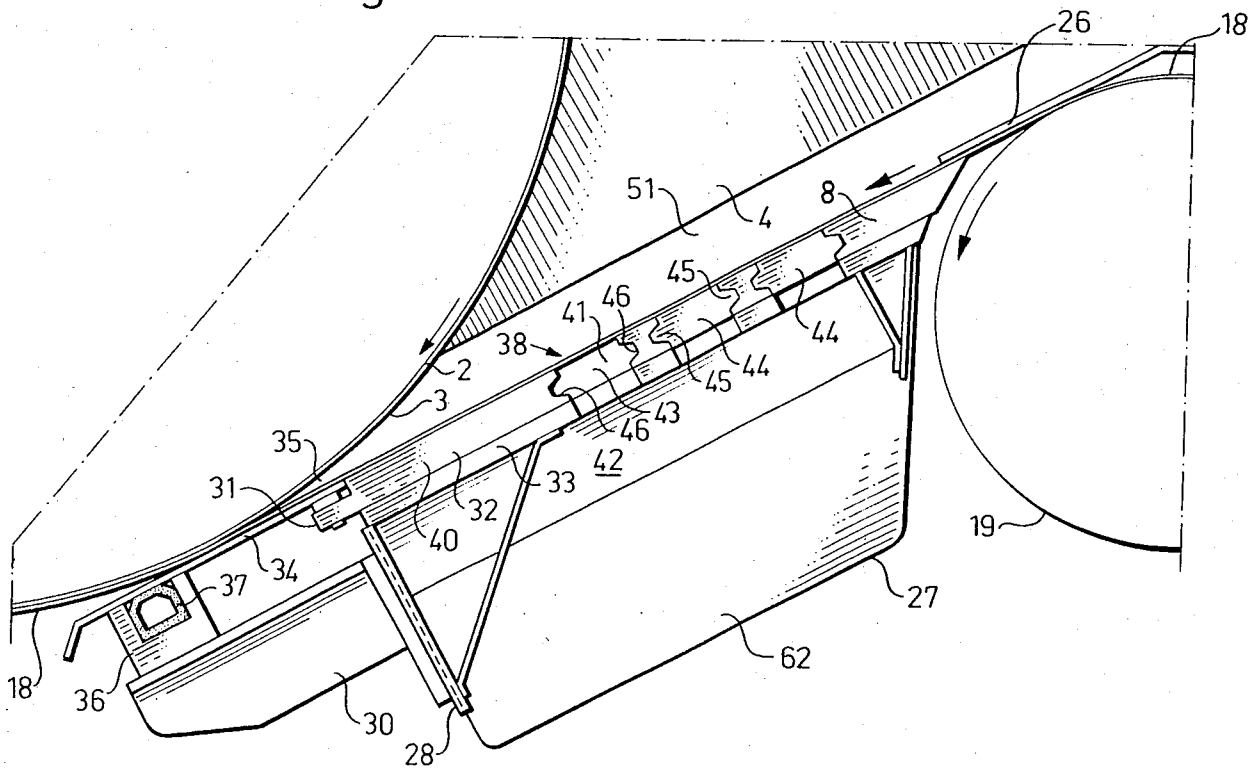
FIG. 2 is an enlarged view of a portion of the machine illustrated in FIG. 1.

The slit means 38 may be included in a cassette-like exchangeable unit, the width of which substantially corresponds, for instance, to the distance between the groove located furthest upstream and that located furthest downstream as seen in FIG. 2. This unit may then be inserted from the side of the platform in the same way as an individual bar 44, but in a correspondingly wider opening. The means according to the invention may include two or more such exchangeable units, each unit being provided with drainage passages in accordance with the embodiment shown, having through-flow areas greater or smaller than the through-flow areas of another unit. The drainage passages of a unit may be closable, e.g. by means of bars as described, or non-closable. One unit may be completely closed, for instance having no slits which normally form drainage passages.

The vat paper machine shown and described above, provided with one outer wire, is particularly suitable for the manufacture of security paper having true watermarks. Such security paper can then be manufactured at higher speeds and/or with higher grammages, while still retaining the desired formation and desired uniform grammage.

That which is claimed is:

1. A vat paper machine comprising a vat having a bottom wall, a headbox connected to the vat for providing a continuous supply of stock to a predetermined level in the vat, a rotatable cylinder mold having a wire gauze covered outer surface, said cylinder mold is positioned relative to the vat that upon rotation of the cylinder mold, the wire gauze covered surface is brought into contact with the stock in the vat to form a first web thereon by draining water from the stock through said wire gauze covered surface, an outer wire forming an endless loop in said vat machine, a breast roll located adjacent the bottom wall of said vat and supporting said outer wire so as to extend along a path of travel from the breast roll through the vat along said bottom wall and then over and around a portion of the circumference of said cylinder mold, and said bottom wall of the vat including a platform located between said breast roll and said cylinder mold and underlying said outer wire, and said platform including slit means forming at least one drainage passage for forming a second web on the outer wire by draining water from the stock through said outer wire and through said at least one drainage passage, said at least one drainage passage being parallel to the axis of rotation of the cylinder mold and being arranged at a predetermined distance upstream from the nip defined by the outer wire and the cylinder mold, whereby the second web formed on the outer wire is couched with the first web to form a unitary web.

2. A machine according to claim 1 wherein said at least one drainage passages comprises a plurality of drainage passages.

3. A machine according to claim 1 wherein said slit means includes closure means for adjusting the total flow-through area of the at least one drainage passage and thereby regulating the grammage of the couched web.

4. A machine according to claim 3 wherein said closure means comprises a removable elongate bar having an upper surface arranged to lie in the plane of the upper surface of said platform and to contact the outer wire.

5. A machine according to claim 1 wherein said platform further includes an elastic sealing lip at a location where the outer wire overlies the cylinder mold and being arranged to press against the outer wire and the cylinder mold.

6. A machine according to claim 5 including pressure generating means connected to said elastic sealing lip for producing a controlled pressure of the sealing lip against the outer wire and the cylinder mold.

7. A machine according to claim 1 further including pivotal mounting means connected to said platform for pivotally adjusting the position of said platform relative to the cylinder mold to permit accommodating a variety of cylinder mold sizes in the same machine.

8. A machine according to claim 7 wherein said pivotal mounting means includes a pair of parallel support arms provided with bearing means for pivotable journalling of the platform about the axis of rotation of the breast roll.

9. A machine according to claim 1 wherein said platform includes a section impervious to water and located between the slit means and said nip and extending in the machine direction a distance of at least about 20 cm.

10. A machine according to claim 1 including a movable curtain connected to the cylinder mold to permit adjusting the starting line for a forming zone on the cylinder mold.

11. A machine according to claim 1 wherein said cylinder mold includes means for effecting water marks in the web.

* * * * *